US005988223A

United States Patent [19]

Kanzaki et al.

[11] Patent Number: 5,988,223

[45] Date of Patent: Nov. 23, 1999

[54] SEALING PLUG DEVICE FOR A REFRIGERANT COMPRESSOR

[75] Inventors: Shigeki Kanzaki; Takahiro Hoshida; Minoru Mera, all of Kariya, Japan

[73] Assignee: Kabushiki Kaisha Toyoda Jidoshokki Seisakusho, Kariya, Japan

[21] Appl. No.: 08/979,976

[22] Filed: Nov. 26, 1997

[30] Foreign Application Priority Data

Nov. 28, 1996 [JP] Japan ..... 8-317967

[51] Int. Cl.[6] ..... F16L 55/11

[52] U.S. Cl. ..... 138/89; 138/92; 138/96 R

[58] Field of Search ..... 138/89, 89.2, 92, 138/94.5, 96 R

[56] References Cited

U.S. PATENT DOCUMENTS

| | | | |
|---|---|---|---|
| 127,620 | 6/1872 | Lowe | 138/92 |
| 1,827,663 | 10/1931 | Mastrillo | 138/92 |
| 3,777,926 | 12/1973 | Stieler et al. | 138/89 |
| 4,979,885 | 12/1990 | Yasuda et al. . | |

FOREIGN PATENT DOCUMENTS

| | | |
|---|---|---|
| 7927235 | 9/1979 | Germany . |
| 8336505 | 12/1983 | Germany . |
| 410478 | 3/1992 | Japan . |

*Primary Examiner*—James F. Hook
*Attorney, Agent, or Firm*—Burgess, Ryan & Wayne

[57] ABSTRACT

A removable sealing plug device for protecting the interior of a refrigerant compressor from dust, dirt, and corrosion during storage and/or transport of the compressor before it is assembled into a refrigerating system, including a plug element made of a rubber material and having a body portion adapted to being sealingly fitted in an inlet and/or outlet port of the compressor and a columnar head portion formed in an upper face of the body portion, and a base plate element having a through-bore in which the columnar head of the plug element is fitted with an interference fit, the base plate being secured to the outer circumference of the compressor, by using an existing threaded hole and a screw bolt, to hold the plug element between the base plate element and the outer circumference of the compressor. The plug element of the sealing plug device is provided with a handle portion extending laterally from the body portion thereof to permit the sealing plug device to be easily removed from the inlet port and/or outlet port of the compressor.

12 Claims, 5 Drawing Sheets

SEALING PLUG DEVICE FOR A REFRIGERANT COMPRESSOR

BACKGROUND OF THE INVENTION

1. Field of the Invention

The present invention relates to a sealing plug device for a refrigerant compressor. More particularly, the present invention relates to a sealing plug device for tightly closing each of inlet and outlet ports of a refrigerant compressor so as to isolate the interior of the compressor from the atmosphere during either the storage of the compressors in a warehouse or the transporting of the compressors from e.g., the warehouse or the manufacturing factory to an automobile assembling site where the compressors are assembled in automobile refrigerating systems, for the purpose of protecting the interior of the compressor against corrosion, dirt and dust.

2. Description of the Related Art

Generally, refrigerant compressors are manufactured and assembled, as an important component of an automobile refrigerating system, in a compressor manufacturing factory. During the final stage of the assembly of respective compressors, each compressor is filled with lubricating oil used for lubricating the interior of the compressor during the operation of the compressor, and also preventing the interior of the compressor from being corroded. For example, as shown in FIG. 8, an inlet port 40*a* of the refrigerant compressor is formed in an outer portion of the compressor, i.e., a pipe connecting portion 40 to which suction and delivery pipes of a refrigerating system are connected.

Therefore, after the filling of the lubricating oil into the interior of the compressor, the inlet port 40*a* of the compressor is covered with a cap member 50 made of a rubber to seal and isolate the interior of the compressor from the atmosphere. An outlet port (not shown in FIG. 8) of the compressor is also covered by a similar cap member or a plug member. Then, the compressors are transported from the manufacturing and assembling factory to an automobile manufacturing and assembling factory where each of the compressors is assembled in an automobile refrigerating system. Namely, during the assembly of the automobile refrigerating system, the compressor is connected to a condenser and an evaporator of the refrigerating system via the suction and delivery pipes, and pipe joints. Therefore, before assembling the compressor into the refrigerating system, the cap members 50 covering the inlet port and/or the outlet port must be removed so that the suction pipe can be connected to the inlet port 40*a* via the pipe connector. Similarly, the delivery pipe is connected to the outlet port of the compressor via the pipe connector after the removal of the cap from the outlet port.

FIG. 9 illustrates a different cap member for closing and sealing inlet and outlet ports of a refrigerant compressor according to the prior art. The cap member 60 used for closing the suction port 40*a* of the pipe connecting portion 40 of the compressor is made of synthetic resin material and has a body portion 60*a*, an arm portion 60*b* laterally extending from the body portion 60*a*, and a hand portion 60*c* vertically extending from the end of the arm portion 60*b*. The arm portion 60*b* of the cap member 60 is secured to an upper portion of the connection portion 40 of the compressor by using a screw bolt 61 threadedly engaged in a threaded hole which is formed in the pipe connecting portion 40 to be inherently used for attaching a pipe joint for connecting a suction pipe to the suction port 40*a* when the compressor is assembled in an automobile refrigerating system. The body portion 60*a* of the cap member 60 is provided with a seal ring 62 fitted in an annular groove formed in the outer circumference of the body portion 60, and seals the suction port 40*a* of the compressor.

The afore-described cap member 50 of the prior art is securely attached to the suction port 40*a* of the connecting portion 40 by using only the elasticity of the cap member 50 itself, and therefore, during the transportation of the compressor, the cap member 50 might be loosened due to vibration and shocks, and eventually might come out of the suction port 40*a*. Further, there often occurs that the compressors must be stocked in a warehouse before they are assembled in automobile refrigerating systems for a rather long time. Thus, when the compressors are stocked, they are filled with gas to protect the interior of each compressor from dust and dirt, and corrosion. The gas used for this purpose is either helium gas or nitrogen gas which is filled into the interior of the compressors after the respective compressors are evacuated so that the pressure of the gas is higher than the atmospheric pressure. Therefore, the high pressure of the gas may cause the loosening of the cap member 50, and allows the cap member 50 to come out of the suction port 40*a*.

The latter cap member 60 is tightly secured to the connecting portion 40 of the compressor by the screw bolt 61, and accordingly, the cap member 60 can be surely prevented from coming out of the suction port 40*a* of the compressor. Nevertheless, since the cap member 60 is made of synthetic resin material having a sufficient rigidity, the needle of a syringe used for evacuating the interior of the compressor and filling the gas in the compressor cannot be easily inserted into the interior of the compressor by piercing through the cap member 60.

SUMMARY OF THE INVENTION

Therefore, an object of the present invention is to provide a sealing plug device for sealingly closing inlet and outlet ports of a refrigerant compressor which can be easily attached to and removed from the inlet and outlet ports when needed, and can permit a gas to be easily filled into the interior of the compressor.

In accordance with the present invention, there is provided a sealing plug device for fluid-tightly closing at least one of the inlet and outlet ports of a refrigerant compressor in which the inlet and outlet ports for refrigerant are formed in an outer part of the compressor so as to be connectable to suction and delivery pipes via pipe joints, the outer portion of the refrigerant compressor being further provided with threaded holes formed at respective positions adjacent to the inlet and outlet ports so as to be used for fixing the pipe joints, the sealing plug device protecting the interior of the compressor from dust, dirt and corrosion, and comprising:

a plug element made of rubber material and including a body portion adapted to being tightly fitted in at least one of the inlet and outlet ports, and a columnar head formed in an upper surface of the body portion to be vertically projecting from the upper surface; and a base plate element adapted to being mounted on the plug element to secure the plug element to the outer portion of the compressor by using one of the threaded holes, the base plate having a through-hole in which the columnar head of the plug element is fitted, wherein the body portion of the plug element is provided with a handle portion formed in a marginal portion of the upper surface thereof, the handle portion being arranged between the outer portion of the compressor and the base plate element so as to extend externally from a part of the body portion toward a position beyond the base plate element.

In the above-described sealing plug device for closing at least one of the inlet and outlet ports, the body portion of the plug element made of rubber material can be press-fitted in the inlet or outlet port to removably but tightly close the inlet or outlet port.

Further, the plug element can be secured to the outer portion of the refrigerant compressor when the base plate element is mounted on the body portion of the plug element, and is fixed to the outer portion of the compressor by a screw bolt member which is threadedly engaged in the threaded hole of the outer portion of the compressor. At this stage, since the handle portion of the plug element positioned between the outer portion of the compressor and the base plate element extends externally from the body portion toward a position beyond the base plate element, the plug element together with the base plate element can be easily removed by using the handle portion. Thus, the body portion of the plug element can be surely taken out of the inlet or outlet port of the compressor without a portion of the body portion being left in the inlet or outlet port of the compressor.

Preferably, the base plate element is provided with a positioning means for permitting the handle portion of the body portion to extend therefrom toward a predetermined orientation with respect to the threaded hole of the compressor. The positioning means of the base plate element may be comprised of an engaging recess formed in the base plate element to receive the handle portion of the body portion, the engaging recess being arranged in a face of the base plate element facing the handle portion.

Since the handle portion of the body portion of the plug element extends in the predetermined orientation with respect to the threaded hole of the outer portion of the compressor, it is possible to arrange the handle portion of the body portion of the plug element so that the handle portion does not interfere with the body of the compressor. Particularly, the engaging recess of the base plate element receiving the handle portion of the body portion can easily set it to have the predetermined orientation.

The plug element including the body portion, the columnar head portion, and the handle portion is made of rubber material. Accordingly, the needle of a syringe can easily pierce the plug element so that the interior of the compressor can be evacuated and filled with a predetermined amount of a specific gas such as helium gas or nitrogen gas by using the syringe.

Preferably, the body portion of the plug element is further provided with a flange formed integrally therewith at a position suitable for being fixedly held between the outer portion of the compressor and the base plate element of the sealing plug device. Then, the handle portion of the plug element may be formed as a projection extending outward from a portion of the flange.

Since the above-described flange and the handle portion integrally formed with the body portion are fixedly held between the outer portion of the compressor and the base plate element fixed to the compressor, when the needle of the syringe pierces the body portion of the plug element, and when the interior of the compressor is evacuated, the flange can function to resist a force which pulls the body portion of the plug element into the interior of the compressor via the inlet port or the outlet port.

Preferably, the flange of the body portion of the plug element may be provided with a cut end formed in a portion thereof, and the positioning means of the base plate element is comprised of a step formed in a portion of the base plate element to abut against the cut end of the plug element. The abutment of the step of the base plate element and the cut end of the flange of the body portion of the plug element can permit the body portion of the plug element to be positioned so that the handle portion thereof is easily set to have the predetermined orientation with respect to the threaded hole of the outer portion of the compressor.

The flange of the body portion of the plug element may have an extended portion formed to encircle the threaded hole of the outer portion of the compressor, and a through-bore arranged in the extended portion to be in registration with the threaded hole of the outer portion of the compressor, so that the screw bolt for fixing the base plate element to the outer portion of the compressor may be threadedly engaged in the threaded hole. Thus, the flange of the body portion of the plug element is tightly held between the outer portion of the compressor and the base plate element when the screw bolt is tightly threaded in the threaded hole of the outer portion of the compressor. Accordingly, even when the interior of the compressor is evacuated by pushing the needle of the syringe into the body portion, the body portion of the plug element can be immovably held in the inlet or outlet port against the force acting so as to pull the plug element into the inlet or outlet port.

When the flange of the body portion of the plug element has the above-mentioned extended portion thereof, the base plate element may be preferably provided with a recessed portion formed therein and receiving the extended portion so that the recessed portion acts as the positioning means.

When the extended portion of the flange is received by the recessed portion of the base plate element, the handle portion of the body portion of the plug element can be set and positioned to have the predetermined orientation thereof with respect to the threaded hole of the outer portion of the compressor.

When the through-hole of the base plate element is formed to have an inner diameter equal to or smaller than an outer diameter of the columnar head portion, the base plate element can be fitted on the columnar head portion of the plug element by an interference fit to form a single integral element. Therefore, attachment of the sealing plug device to the inlet port or the outlet port may be easily achieved compared with the case where the plug element and the base plate element are completely separate parts.

Particularly, when a part of the through-hole of the base plate element has an inner diameter smaller than an outer diameter of the columnar head portion to provide a fitting interference between the through-hole and the columnar head portion, and when the remaining part of the through-bore of the base plate element is formed in a conically tapered bore of which the diameter is axially enlarged toward the base portion of the columnar head portion of the plug element, the mounting of the base plate element onto the columnar head of the plug element can be simplified by the guidance provided by the conically tapered bore.

BRIEF DESCRIPTION OF THE DRAWINGS

The above and other objects, features, and advantages of the present invention will become apparent after reference to the description of the preferred embodiments of the present invention and the accompanying drawings wherein.

DESCRIPTION OF THE PREFERRED EMBODIMENTS

Figure 7:
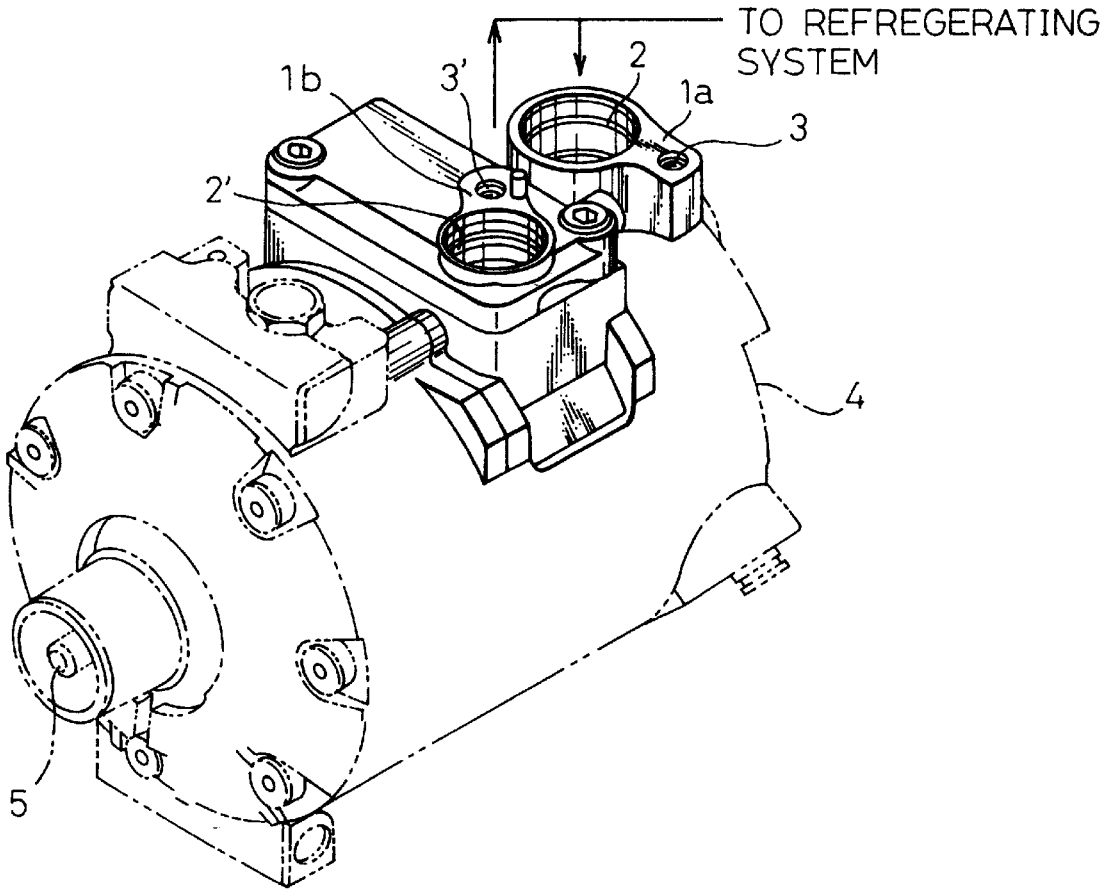
FIG. 7 is a general perspective view of a refrigerant compressor, illustrating an outer portion thereof in which an inlet port and an outlet port are provided to receive suction and delivery pipes of an automobile refrigerating system.
Figure 8:
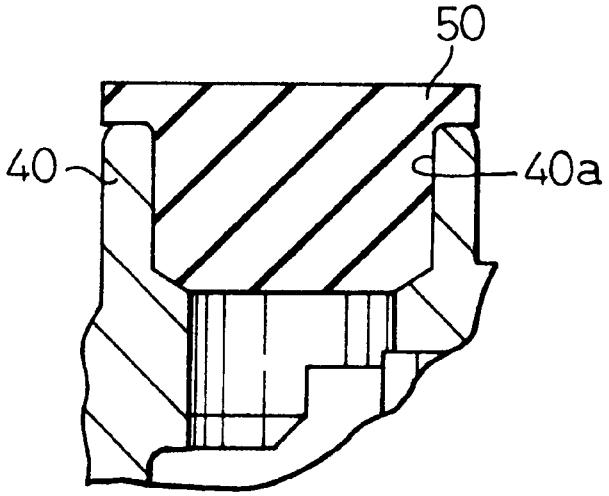
Fig.8 (PRIOR ART)
FIG. 8 is a cross-sectional view of a sealing cap according to a prior art, fitted in an inlet port of a refrigerant compressor.
Figure 9:
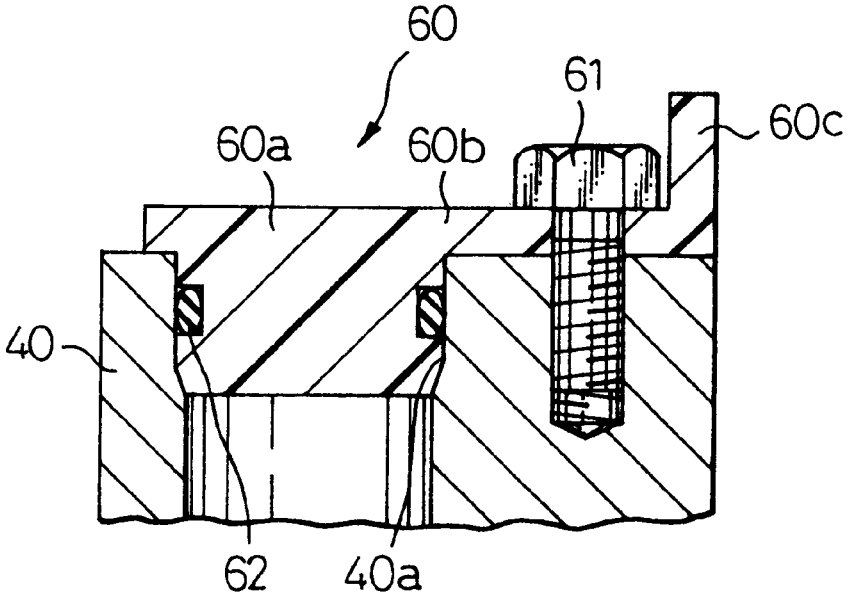
Fig.9 (PRIOR ART)
FIG. 9 is a similar cross-sectional view of a sealing cap according to another prior art.

Referring first to FIG. 7, a typical refrigerant compressor has a cylinder block assembly 4 forming an outer framework of the compressor. The cylinder block assembly 4 has therein a compressing mechanism for sucking and compressing a refrigerant gas within cylinder bores when the refrigerant gas returns from an external refrigerating system via a suction pipe. The compressed refrigerant gas is discharged by the compressing mechanism into a discharge chamber within the cylinder block assembly, and is then delivered toward an external refrigerating system via a delivery pipe. The compressor has a rotatable drive shaft 5 which rotationally drives the compression mechanism usually including a plurality of reciprocating pistons and a rotation-to-reciprocation converting mechanism such as a swash plate mechanism or a wobble plate mechanism.

The cylinder block assembly 4 has a pipe connecting portion 1 arranged at a part of an outer portion of the assembly 4. The pipe connecting portion 1 has a pair of mounts 1*a* and 1*b*. The mount 1*a* is provided with an inlet port 2 which is to be connected to the suction pipe (not shown) via a suitable pipe joint to introduce a refrigerant gas for compression from the external refrigerating system into the interior of the compressor. The suction pipe is secured to the mount 1*a* by a suitable screw bolt (not shown) threadedly engaged in a threaded hole 3 formed in the mount 1*a* and arranged adjacent to the inlet port 2. The mount 1*b* of the pipe connecting portion 1 is provided with an outlet port 2' which is to be connected to the delivery pipe (not shown) via a suitable pipe joint to deliver the refrigerant gas after compression toward the external refrigerating system. The delivery pipe is secured to the mount 1*b* by a suitable screw bolt (not shown) threadedly engaged in a threaded hole 3' formed in the mount 1*b* and arranged adjacent to the outlet port 2'.

Descriptions of sealing plug devices according to a plurality of embodiments of the present invention will be provided hereinbelow. However, it should be generally understood that a sealing plug device according to the present invention may be used for sealingly closing either one of the inlet and outlet ports 2 and 2' of the refrigerant compressor or both of the ports 2 and 2' in order to protect the interior of the compressor from dust, dirt and corrosion before it is assembled into an automobile refrigerating system. The sealing-plug device of the present invention does not have to be used for closing always both of the inlet and outlet ports 2 and 2' of the compressor, but should be used for closing at least one of the inlet and outlet ports 2 and 2' of the compressor when the manufacture and assembly of the compressor is completed in a manufacturing factory. When one of the inlet and outlet ports 2 and 2' is sealingly closed by the sealing plug device of the present invention, the other of the ports 2 and 2' may be tightly closed by a different type of sealing means including the cap 60 of the prior art as required.

Figure 1:
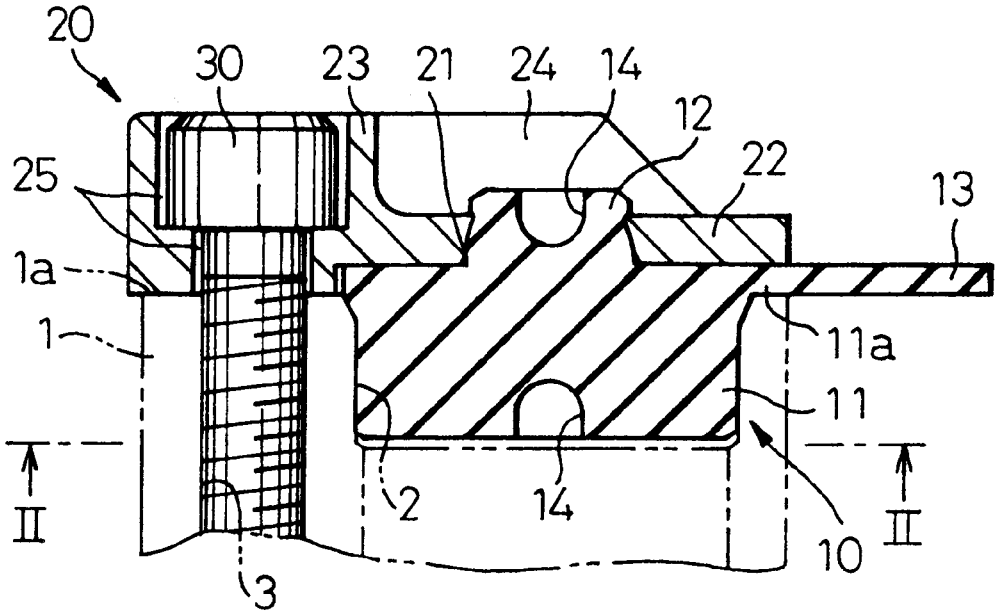
FIG. 1 is a cross-sectional view of a sealing-plug device according to an embodiment of the present invention, taken along the line I—I of FIG. 2.
Figure 2:
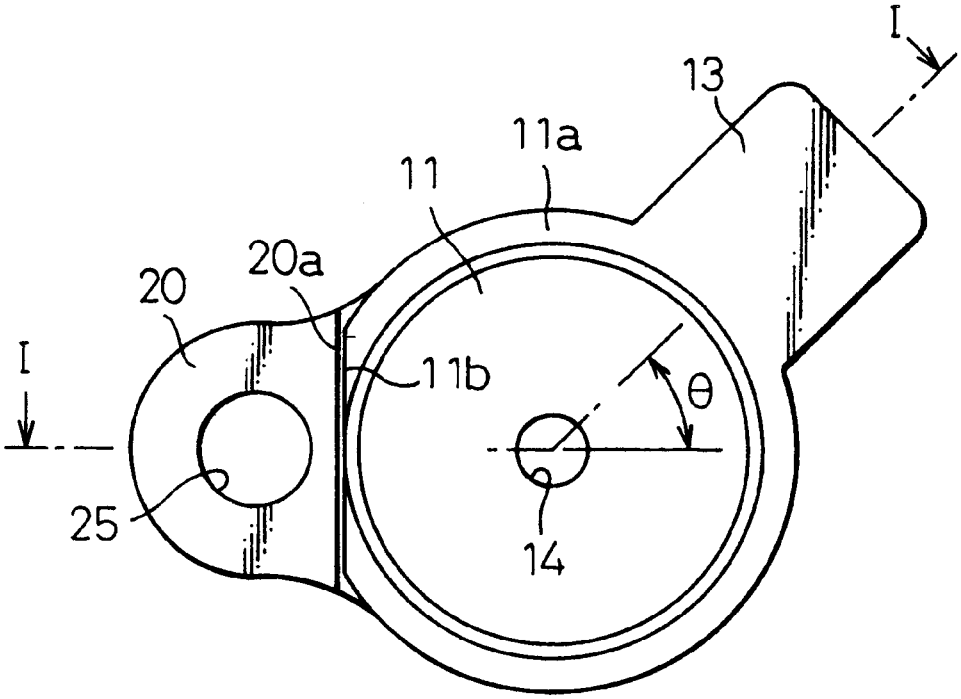
FIG. 2 is an end view of the sealing plug element, in part cross-section taken along the line II—II of FIG. 1.

FIGS. 1 and 2 illustrate a sealing plug device of the first embodiment which is typically used for sealingly closing the inlet port 2 of the mount 1*a* of the pipe connecting portion 1 of the compressor. The sealing plug device includes a plug element 10 made of rubber material. The plug element 10 is provided with a body portion 11 in the shape of a cylindrical body, and a columnar head portion 12 formed in a projection from an upper face of the body portion 11. The body portion 11 has an outer diameter which is equal to or larger than an inner diameter of the inlet port 2. Namely, the body portion 11 is provided with a predetermined amount of interference so that the body portion 11 is press-fitted in the inlet port 2 of the compressor. The axial position of the body portion 11 within the inlet port 2 is limited by a flange 11*a* which comes into contact with an upper mounting face of the mount 1*a* when the body portion 11 is axially forcibly fitted in the inlet port 2.

The sealing plug device further includes a base plate element 20 in the shape of a rib member, which is mounted on the body portion 11. The base plate element 20 is provided with a flat pressing disc 22 in which a through-bore 21 is formed so as to receive the columnar head portion 12 of the plug element 10, and a vertical boss portion 23 continuing with the flat pressing disc 22 and having a through-bore 25 an upper part of which is formed as a counter bore to receive the head of a screw bolt 30 which is threadedly engaged in the threaded hole 3 of the mount 1*a* of the compressor so as to fix the base plate element 20 to the mount 1*a*. Thus, the through-bore 25 of the base plate element 20 is arranged to be substantially coaxial with the threaded hole 3 of the mount 1*a*.

The base plate element 20 is preferably provided with a rib 24 extending from the boss portion 23 toward the circumference of the flat pressing disc 22.

The plug element 10 is provided with a handle portion 13 for allowing the plug element 10 to be easily taken out of the inlet port 2 when the sealing plug device is removed from the compressor. The handle portion 13 is formed to extend from the flange 11*a* laterally with respect to the vertical axis of the plug element 10 and radially with respect to the center of the inlet port 2. Further, the handle portion 13 is arranged in such a manner that the center line of the handle portion is set at a predetermined orientation to permit the handle portion 13 to be freely held by an operator without any interference with a part of the housing assembly 4, especially with the mount 1*a*. Namely, the orientation of the center line of the handle portion 13 is set to have an angle Ø with respect to a line extending through the center of the inlet port 2 and the center of the threaded hole 3 of the mount 1*a* as shown in FIG. 2. The orientation of the handle portion 13 is automatically determined when the cut end 11*b* of the flange 11*a* is mounted to be substantially aligned with a linear engaging end 20*a* of the base plate element 20.

The through-bore 21 of the base plate element 20 may be fitted on the columnar head portion 12 of the plug element 10 without any interference therebetween. Nevertheless, when an interference fit is provided between the columnar head portion 12 of the plug element 10 and the through-bore 21 of the base plate element 20, the plug element 10 and the base plate element 20 may be combined together to become an integral element. As a result, the assembly of the sealing plug device onto the mount 1*a* of the compressor as well as removal thereof from the mount 1*a* of the compressor can be simplified. Further, the afore-mentioned orientation of the handle portion 13 of the plug element 10 with respect to the base plate element 20 can be invariably established when the two elements 10 and 20 are combined together.

Furthermore, when the through-bore 21 of the base plate element 20 is formed to have an interference at only an upper portion thereof, and to have a tapered bore enlarging toward the lowermost portion thereof, the interference fitting of columnar portion 12 of the plug element 10 and the base plate element 10 can be easily achieved.

In the first embodiment shown in FIGS. 1 and 2, the plug element 10 is provided with cavity portions 14 formed in the bottom face of the body portion 11 and in the upper face of the columnar portion 12. The two cavity portions 14 are arranged to be coaxial with one another, so that an axial thickness of the plug element 10 is reduced between the two cavity portions 14. Thus, when a needle of a syringe, used for evacuating the interior of the housing assembly 4 (FIG. 7) of the compressor and filling a specific gas in the interior of the housing assembly 4, pierces the thickness-reduced portion of the plug element 10, the piercing operation of the syringe can be easily achieved with reduced resistance. Therefore, during the insertion of the syringe into the interior of the compressor, an unfavorable deformation in the shape of the plug element 10 made of rubber material can be prevented. Therefore, an accurate position of the sealing plug device in the inlet port 2 of the compressor can be maintained irrespective of an insertion of the needle of the syringe into the interior of the compressor against resistance exerted by the rubber material of which the body portion 11 of the plug element 10 is made.

Before the sealing plug device of FIGS. 1 and 2 is attached to the inlet port 2 of the mount 1*a* of the compressor, the plug element 10 is preliminarily assembled on the base plate element 20 so as to be combined together. At this stage, when the columnar head portion 12 of the plug element 10 is press-fitted in the through-bore 21 of the base plate element 20, the cut end 11*b* of the body portion 11 of the plug element 10 is positioned to be in alignment with the linear engaging end 20*a* of the base plate element 20. During the press-fitting of the columnar head portion 12 of the plug element 10 into the through-bore 21 of the base plate element 10, the tapered portion of the through-bore 21 of the base plate element 10 guides the columnar head portion 12 to be very smoothly inserted into the through-bore 21 of the base plate element 20.

After the assembly of the plug element 10 and the base plate element 20, the sealing-plug device is sealingly attached to the compressor by press-fitting the body portion 11 of the plug element 10 in the inlet port 2 of the compressor. At this stage, the through-bore 25 of the base plate element 20 is suitably brought into a registration with the threaded hole 3 of the mount 1*a*, so that the screw bolt 30 can be threadedly engaged in the threaded hole 3. The press-fitting of the body portion 11 of the plug element 10 is conducted until the lower face of the flange 11*a* of the body portion 11 and a part of the lower face of the base plate element 20 which is substantially even with the lower face of the flange 11*a* are seated on the upper face of the mount 1*a* of the pipe connecting portion 1. When the above-mentioned press-fitting of the body portion 11 is completed, the screw bolt 30 is threadedly engaged in the threaded hole 3 in order to tightly fix the base plate element 20 to the mount 1*a* of the compressor. Thus, the flat pressing disc 22 of the base plate element 20 presses the plug element 10 toward the mount 1*a* of the pipe connecting portion 1 of the compressor. As a result, the sealing plug device is tightly fixed to the pipe connecting portion 1 of the compressor. Subsequently, the needle of the syringe (not shown) can pierce through the cavity portions 14 of the plug element 10 into the interior of the housing assembly 4 of the compressor and the evacuation of the interior of the housing assembly 4 and the filling of a specific gas for protection against corrosion of the interior of the compressor can be conducted. When the evacuation and filing of the specific gas are completed, the protection of the interior of the compressor against dust and dirt is also completed.

It should be noted that the provision of the coaxial cavity portions 14 of the body portion 11 and the columnar head portion 12 can effectively contribute to reduction in the resistance against insertion of the need of the syringe through the rubber plug element 10. Nevertheless, the provision of the two cavity portions 14 is not indispensable for the easy insertion of the needle of the syringe. Provision of one of the cavity portions 14 may also be effective for reducing the resistance against the insertion of the needle of the syringe. Thus, at the final stage of the manufacturing and assembling of the refrigerant compressors, the production efficiency of the compressors can be increased. The refrigerant compressors protected by the sealing plug device from the dust, dirt and corrosion are forwarded to a subsequent stage of assembling the compressors into automobile refrigerating systems after being stored in a warehouse as stock as required. Further, the refrigerant compressors may be transported from the manufacturing factory of the compressors to various automobile manufacturing factories remote therefrom.

When each of the refrigerant compressors provided with sealing-plug devices is transported to the site of assembling it into an automobile refrigerating system, the sealing-plug device must be removed so that the inlet and outlet ports 2 and 2' are connected to suction and delivery pipes. The removal of the sealing plug device is conducted by the method as set out hereinbelow.

First, the screw bolt 30 is threadedly disengaged from the threaded hole 3 of the mount 1*a*. Subsequently, the handle portion 13 of the plug element 10 is grasped by an operator, and the plug element 10 and the base plate element 20 are simultaneously pulled away from the inlet port 2 of the compressor, and the sealing plug device can be easily taken out of the housing assembly 4 of the compressor. Then, the inlet and outlet ports 2 and 2' of the compressor from which the sealing-plug device is removed are connected to the suction and delivery pipes by using the pipe joints.

Figure 3:
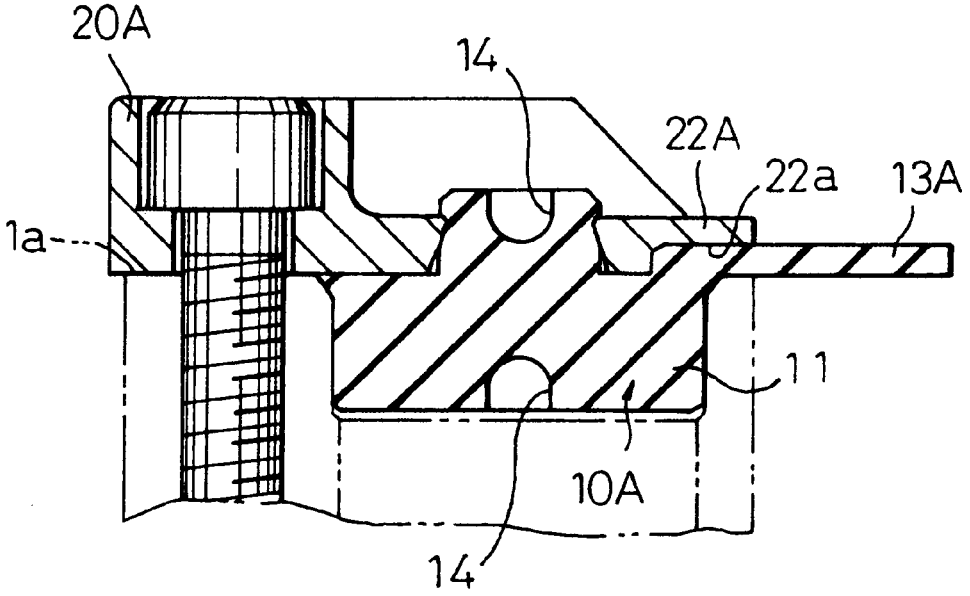
FIG. 3 is a cross-sectional view of a sealing-plug device according to a second embodiment of the present invention.

FIG. 3 illustrates a sealing plug device according to a second embodiment of the present invention. The sealing plug device of the second embodiment is different from that of the first embodiment in that a base plate element 20A is provided with a flat pressing disc 22A having a lower recessed portion 22*a* in which a part of a handle portion 13A is received and positioned so that the orientation of the center line of the handle portion 13A is determined. The handle portion 13A is formed as an integral part of the body portion 11 of a plug element 10A. It should be noted that the body portion 11 of the plug element 10A is not provided with a flange which acts so as to prevent the plug element 10A from being pulled into the inlet or outlet port 2 or 2'. Nevertheless, the portion of the handle portion 13A which is held in the lower recessed portion 22*a* and sandwiched between the flat pressing disc 22A and the upper end of the mount 1*a* of the compressor can resist a force which acts to pull the plug element 10A into the inlet or outlet port 2 or 2' when the needle of the syringe is inserted into the interior of the compressor, and when the interior of the compressor is evacuated.

Further, the inlet or outlet port 2 or 2' may be provided with a step portion therein to receive and support the lowermost end of the body portion 11 of the plug element 10A as required. The support of the body portion 11 of the plug element 10A can surely prevent the plug element 10A from being pulled into the inlet or outlet port 2 or 2'.

Figure 4:
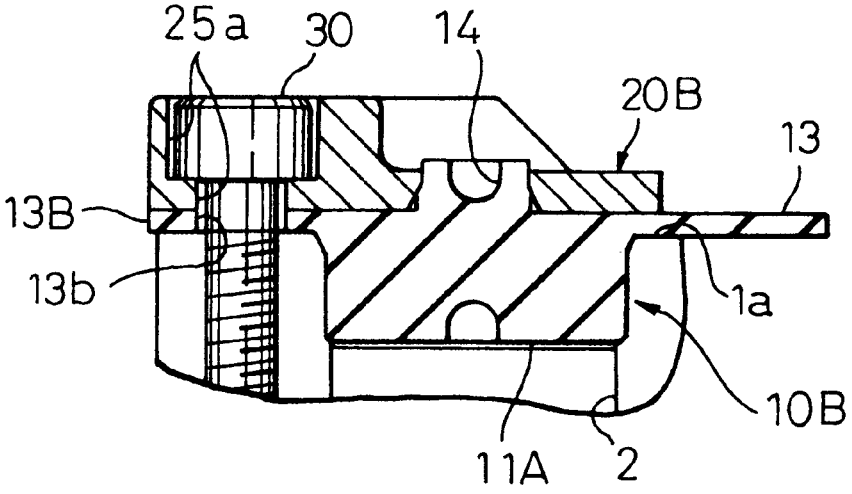
FIG. 4 is a cross-sectional view of a sealing-plug device according to a third embodiment of the present invention.

FIG. 4 illustrates a sealing plug device according to a third embodiment of the present invention. The sealing plug device of the third embodiment is different from the device of the first embodiment in that the body portion 11A of the plug element 10B is provided with an extended flange portion 13B at an upper face thereof. The extended flange 13B extends from a cylindrical central portion of the body portion 11A toward a position surrounding the threaded hole 3 in which a screw bolt 30 is threadedly engaged, and has a through-hole 13*b* for the insertion of the screw bolt 30. Therefore, the through-hole 13*b* of the plug element 10B is in registration with the through-bore 25*a* of the base plate element 20B which is substantially the same as the base plate element 20 of the first embodiment. When the screw bolt 30 is threadedly engaged with the threaded hole 3 of the mount 1*a* of the compressor, the plug element 10B together with the base plate element 20B of the sealing plug device is fixed to the mount 1*a*.

It should be noted that the extended flange portion 13*b* can contribute to prevention of the plug element 10B from being pulled into the inlet port 2. Particularly, since the extended flange portion 13B of the body portion 11A is rigidly held between the base plate element 20B and the upper end of the mount 1*a* by the tightening force of the screw bolt 30, the plug element 10B can be more surely prevented from being pulled inward into the inlet port 2 can be further ensured.

It should further be noted that the predetermined orientation of the handle portion 13 of the body portion 11A of the plug element 10B can be automatically obtained when the through-hole 13*b* of the extended flange 13B is brought into registration with the through-bore 25*a* of the base plate element 20B during the assembly of the two elements 10B and 20B.

Figure 5:
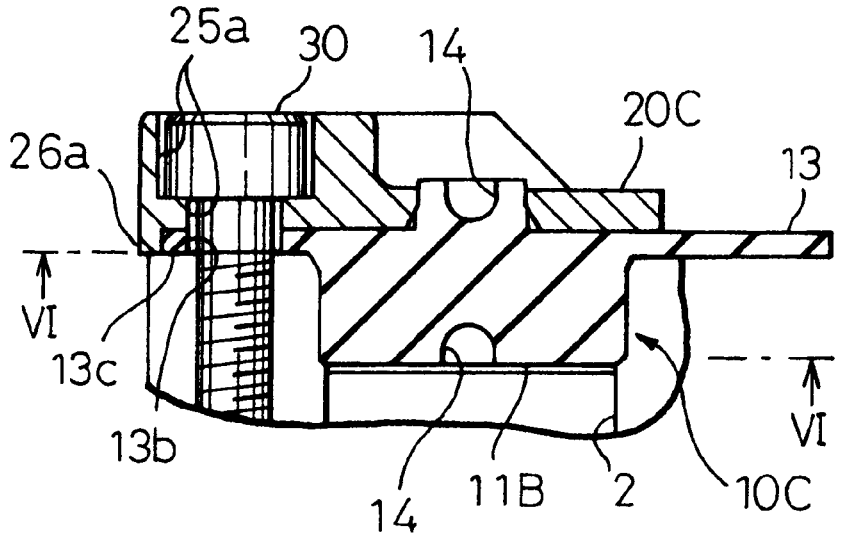
FIG. 5 is a cross-sectional view of a sealing-plug device according to a fourth embodiment of the present invention.
Figure 6:
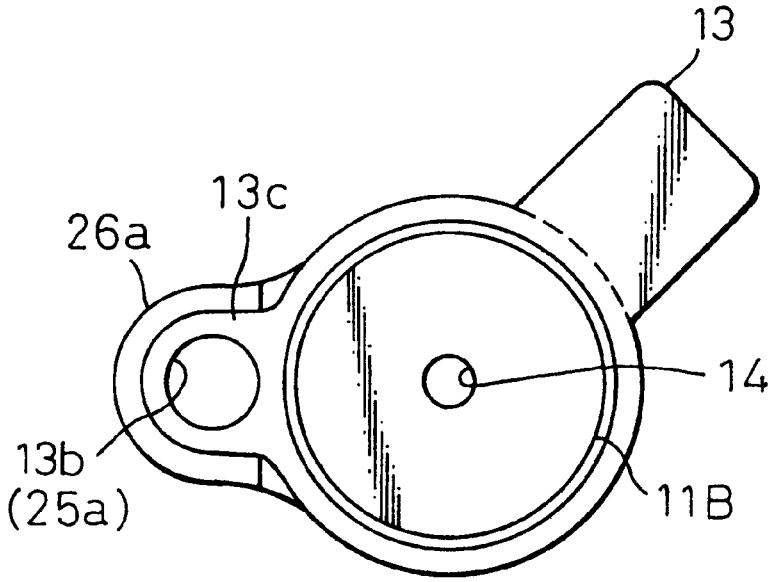
FIG. 6 is an end view of the sealing-plug device of the fourth embodiment, taken along the line VI—VI of FIG. 5.

FIGS. 5 and 6 illustrate a sealing plug device of a fourth embodiment of the present invention. The sealing plug device of the fourth embodiment is provided with a plug element 10C having a body portion 11B and a base plate element 20C, and is different from that of the third embodiment in that the base plate element 20C is provided with an arcuate or circularly extending rib portion 26*a* formed in a part of the lower face of the base plate element 20C to define a recessed portion for receiving an extended flange portion 13C of a body portion 11B of the plug element 10B which is substantially the same as the extended flange portion 13B of the third embodiment. In the fourth embodiment, when the extended flange portion 13C of the body portion 11B is positioned in the above-mentioned recessed portion, and is engaged with the circularly extending rib portion 26*a* of the base plate element 20C, the handle portion 13 of the body portion 11B can be set to have a predetermined orientation.

It should be understood that the plug element 10C and the base plate element 20C of the fourth embodiment can be combined together in a similar manner to the first through third embodiments to form an integral element. The combined integral element is then secured to the mount 1*a* of the compressor by using a screw bolt 30.

From the foregoing description of the first through fourth embodiments of the present invention, it will be understood that, in accordance with the present invention, the sealing plug device for protecting the interior of a refrigerant compressor can be an easily and removably attached device and can surely seal the inlet and/or outlet port of the compressor. Therefore, the production efficiency of the refrigerant compressors in the compressor manufacturing factory can be increased.

Many and various modifications will be made by persons skilled in the art without departing from the scope and spirit of the invention claimed in the accompanying claims.

What we claim is:

1. A sealing plug device for fluid-tightly closing at least one of inlet and outlet ports of a refrigerant compressor in which the inlet and outlet ports for refrigerant are formed in an outer part of the compressor so as to be connectable to suction and delivery pipes via pipe joints, the outer portion of the compressor being further provided with threaded holes formed at respective positions adjacent to the inlet and outlet ports so as to be used for fixing the pipe joints, the sealing plug device protecting the interior of the compressor from dust, dirt and corrosion, and comprising:

a plug element made of rubber material and including a body portion adapted for being tightly fitted in at least one of said inlet and outlet ports, and a columnar head formed in an upper surface of said body portion to be vertically projecting from said upper surface; and a base plate element adapted for being mounted on said plug element to secure said plug element to said outer portion of said compressor by using one of said threaded holes, said base plate having a through-hole in which said columnar head of said plug element is fitted, wherein said body portion of said plug element is provided with a handle portion formed in a marginal portion of said upper surface thereof, said handle portion being arranged between said outer portion of said compressor and said base plate element so as to extend externally from a part of said body portion toward a position beyond the base plate element.

2. A sealing plug device according to claim 1, wherein said base plate element is provided with a positioning means for permitting said handle portion of said body portion to extend therefrom toward a predetermined orientation with respect to said threaded hole of the compressor.

3. A sealing plug device according to claim 2, wherein said positioning means of said base plate element comprises an engaging recess formed in said base plate to receive said handle portion of said body portion, said engaging recess being arranged in a face of said base plate element facing said handle portion.

4. A sealing plug device according to claim 1, wherein said body portion of said plug element is further provided with a flange formed integrally therewith at a position suitable for being fixedly held between said outer portion of said compressor and said base plate element of said sealing plug device.

5. A sealing plug device according to claim 4, wherein said handle portion of said plug element is formed as a projection extending outward from a portion of said flange.

6. A sealing plug device according to claim 4, wherein said flange of said body portion of said plug element is provided with a cut end formed in a portion thereof, and said positioning means of said base plate element comprises a step formed in a portion of said base plate element to abut against said cut end of said plug element.

7. A sealing plug device according to claim 6, wherein said flange of said body portion of said plug element has an extended portion formed to encircle said threaded hole of said outer portion of said compressor, and a through-bore arranged in said extended portion to be in registration with said threaded hole of said outer portion of said compressor, so that a screw bolt for fixing said base plate element to said outer portion of said compressor can be threadedly engaged in said threaded hole.

8. A sealing plug device according to claim 7, wherein said base plate element is provided with a recessed portion formed therein to receive said extended portion of said flange of said body portion of said plug element, said recessed portion of said base plate element being arranged to form said positioning means.

9. A sealing plug device according to claim 8, wherein said base plate element is provided with a rib portion formed in a lower face thereof, said rib portion defining said recessed portion receiving said extended portion of said flange, said rib portion engaging said extended portion of said flange when said base plate element is mounted on said plug element.

10. A sealing plug device according to claim 1, wherein said through-hole of said base plate element has, in a part thereof, an inner diameter smaller than an outer diameter of said columnar head portion to provide an interference fit between said through-hole and said columnar head portion, the remaining part of said through-bore being formed in a conically tapered bore of which the diameter is axially enlarged toward a base portion of said columnar head portion of said plug element.

11. A sealing plug device for fluid-tightly closing at least one of the inlet and outlet ports of a refrigerant compressor in which the inlet and outlet ports for refrigerant are formed in an outer part of the compressor so as to be connectable to suction and delivery pipes via pipe joints, the outer portion of the compressor being further provided with threaded holes formed at respective positions adjacent to the inlet and outlet ports so as to be used for fixing the pipe joints, the sealing plug device protecting the interior of the compressor from dust, dirt and corrosion, and comprising:

a plug element made of rubber material and including a body portion adapted to being tightly fitted in at least one of said inlet and outlet ports, and a columnar head formed in an upper surface of said body portion to be vertically projecting from said upper surface; and a base plate element adapted for being mounted on said plug element to secure said plug element to said outer portion of said compressor by using one of said threaded holes, said base plate element having a through-hole in which said columnar head of said plug element is fitted, wherein said body portion of said plug element is provided with a handle portion formed in a marginal portion of said upper surface thereof, said handle portion being arranged between said outer portion of said compressor and said base plate element so as to extend externally from a part of said body portion toward a position beyond the base plate element, and wherein said base plate element is provided with a positioning means for permitting said handle portion of said body portion to extend therefrom toward a predetermined orientation with respect to said threaded hole of the compressor.

12. A sealing plug device for fluid-tightly closing at least one of inlet and outlet ports of a refrigerant compressor in which the inlet and outlet ports for refrigerant are formed in an outer part of the compressor so as to be connectable to suction and delivery pipes via pipe joints, the outer portion of the compressor being further provided with threaded holes formed at respective positions adjacent to the inlet and outlet ports so as to be used for fixing the pipe joints, the sealing plug device protecting the interior of the compressor from dust, dirt and corrosion, and comprising:

a plug element made of a rubber material and including a body portion adapted to being tightly fitted in at least one of said inlet and outlet ports, and a columnar head formed in an upper surface of said body portion to be vertically projecting from said upper surface; and a base plate element adapted for being mounted on said plug element to secure said plug element to said outer portion of said compressor by using one of said threaded holes, said base plate having a through-hole in which said columnar head of said plug element is fitted, wherein said body portion of said plug element is provided with a handle portion formed in a marginal portion of said upper surface thereof, and a flange formed integrally therewith at a position suitable for being fixedly held between said outer portion of said compressor and said base plate element of said sealing plug device, wherein said handle portion is formed as a projection extending outward from a portion of said flange and arranged between said outer portion of said compressor and said base plate element so as to extend externally toward a position beyond said base plate element.

* * * * *